United States Patent [19]

Barnett

[11] 4,226,456

[45] Oct. 7, 1980

[54] CONTAINER AND CONTAINER LID

[76] Inventor: John C. Barnett, R.D. 5, Box 5309, Lake Ariel, Pa. 18436

[21] Appl. No.: 3,292

[22] Filed: Jan. 15, 1979

[51] Int. Cl.[3] ..... A01K 29/00; A47L 13/52

[52] U.S. Cl. ..... 294/1 B; 15/257.1; 220/306; 220/326; 294/55

[58] Field of Search ..... 294/1 B, 1 BA, 1 BB, 294/55; 15/104.8, 257.1, 257.4, 257.6; 206/216; 215/287, 290, 293; 220/85 R, 85 D, 90, 306, 307, 326, 356; 229/43; 401/128, 130

[56] References Cited

U.S. PATENT DOCUMENTS

| | | | |
|---|---|---|---|
| 1,840,662 | 1/1932 | Fischer | 220/85 D X |
| 1,990,026 | 2/1935 | Glen | 15/257.6 |
| 2,035,560 | 3/1936 | McCarty | 220/85 R X |
| 2,493,086 | 1/1950 | Reifsnyder | 229/43 |
| 3,156,941 | 11/1964 | Tomainolo | 15/257.1 |
| 3,301,427 | 1/1967 | Roman | 215/287 |
| 3,381,872 | 5/1968 | Holder et al. | 220/356 X |
| 3,455,500 | 7/1969 | Wilcox | 229/43 |
| 4,017,015 | 4/1977 | Jefferson | 294/55 X |

FOREIGN PATENT DOCUMENTS

| | | | |
|---|---|---|---|
| 861319 | 1/1971 | Canada | 220/85 D |

*Primary Examiner*—Johnny D. Cherry
*Attorney, Agent, or Firm*—Kirschstein, Kirschstein, Ottinger & Cobrin

[57] ABSTRACT

A container and lid therefor in which the lid has annular or perimetral structure for mounting the lid on the container, as well as a dependent integral scoop for removal of a substance from a surface. The lid and scoop combination per se is especially intended for the removal of dog droppings, i.e. dog feces, from sidewalks, etc. in the urban environment. Thereafter, the lid-scoop member laden with dog feces may be fitted onto the open end of a used container such as a used standard steel can, e.g. a used and empty soup, vegetable or dog food can. The container lid features, in addition to the integral scoop, perimetral elements about the disc-shaped lid for securing the disc-shaped lid member to the circular top free edge of the open cylindrical container, e.g. a used standard steel can. These perimetral elements include inner and outer circular protuberances on opposite sides of an annular channel in the disc-shaped member.

12 Claims, 9 Drawing Figures

FIG. 1
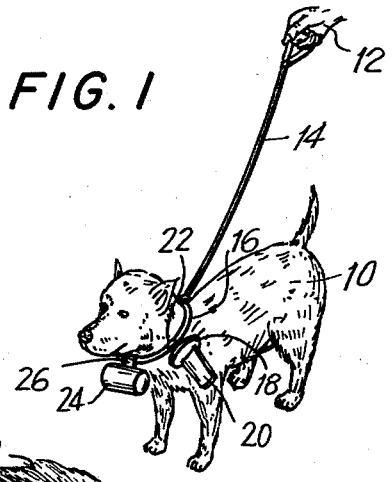
FIG. 1A
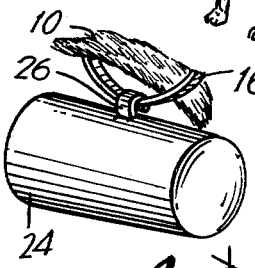
FIG. 2
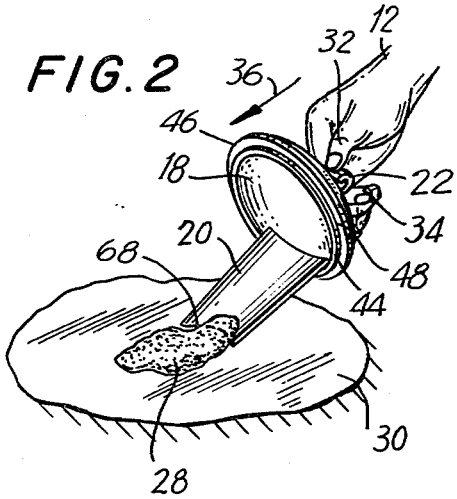
FIG. 3
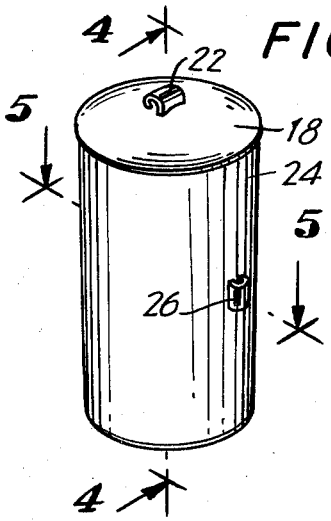
FIG. 6
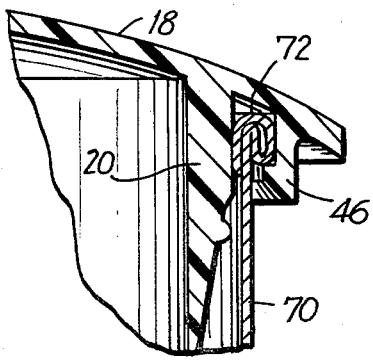
FIG. 7
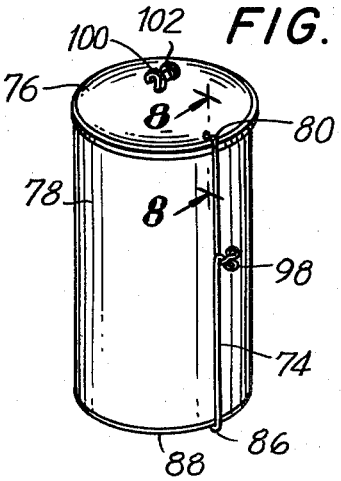
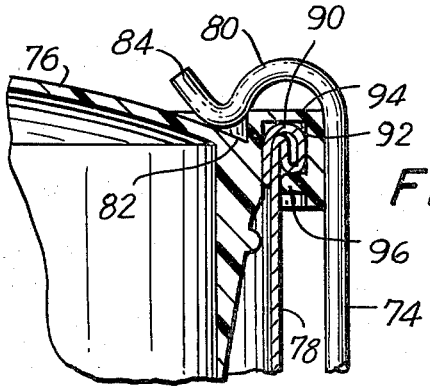
FIG. 8

CONTAINER AND CONTAINER LID

BACKGROUND OF THE INVENTION

1. Field of the Invention

A container lid with integral scoop, and an open-mouthed container, the lid fitting onto the container mouth with the scoop inside the container. The lid with integral scoop is especially intended for usage in removal of dog droppings, i.e. dog feces, from the urban environment by manual manipulation of the lid to scoop up the dog feces, after which the lid is fitted over the open mouth of a used standard steel can such as a used and empty soup, vegetable or dog food can, with the scoop and dog feces inside the can, after which the can containing the removed dog feces may be suitably discarded.

2. Description of the Prior Art

The problem of dog feces deposited on sidewalks, walkways, in parks, etc., is ubiquitous, especially in urban areas. Although most cities and municipalities have adopted ordinances requiring the dog owner to curb his dog, this law is seldom observed in many areas and enforcement of the law is difficult since law enforcement officers are, in many instances, devoting their time to more serious crimes. Thus, deposited dog feces is prevalent in many urban areas. Besides being unsightly and unsanitary, typically soiling the shoes of unwary pedestrians, deposited dog feces is a serious health hazard to small children who often play with and even ingest the dog feces due to natural instinct and curiosity, thinking that it is food. This can lead to serious illness in the child such as worms or digestive upsets.

In addition, it is well known that flies, such as the common housefly, the blue-tailed fly and the horsefly, exhibit a natural predilection, a certain propensity and an unfortunate proclivity to swarm about, light on, and crawl over deposited dog feces. Flies are naturally attracted and drawn to deposited dog feces for several reasons, inter alia, the natural biological urge to deposit eggs which mature into maggots on the dog feces.

In any event, flies also endeavor to gain access to the premises of humans, wherein they proceed to land on and crawl over food, personal possessions and property such as kitchen utensils, and even to crawl on and bite human beings, especially small children, toddlers and infants. Thus, the flies tend to communicate and spread disease, and to soil the interior of dwellings, by the transmission of bacteria from the dog droppings into the presence of humans in houses and apartments, principally because the legs of flies terminate with porous and moist feet, to which dog feces naturally tends to cling. The present container and container lid clearly functions to preclude such unhealthy and unsanitary spread of dog feces and disease into the lives of humans, by eliminating the deposited dog feces from sidewalks, curbs, streets, parks, etc. in urban areas and suburban areas.

Other instances where a small, portable manual scoop is usable include diverse occupations such as park department employees, e.g. persons assigned to removal of leaves and small twigs from the ground, factory workers, homeowners, military personnel assigned to policing an area such as in the vicinity of the barracks, etc. In general, the present container and container lid provides a cheap and disposable means for the collection of refuse such as machine shop waste, e.g. nuts and bolts, glue, sawdust, waste such as suet generated during the slaughtering and/or butchering of animals, vegetable waste in canneries and packing plants, dog feces, household kitchen cleanup, engine grease, and so forth, or for the inexpensive storage of diverse collected materials.

With specific regard to dog drop scoops per se, a body of prior art has been developed in recent years because of the need for an inexpensive, workable device to accomplish the elimination of dog droppings, i.e. dog feces, from the urban environment, and also in response to the more stringent laws relative to pollution which have been enacted in recent years. The urging of environmentalists in this regard is well known, and there is a continuing debate between such groups and those who have dogs as pets or for security reasons, i.e. as protection against intrusion in the dwelling by criminals intent on burglary, robbery or even rape or murder. This is especially true in certain urban areas, where the vast majority of perceptive people keep one or more guard dogs in their dwellings.

Among the many prior art patents relating to the highly developed art of dog drop scoops which may be mentioned are U.S. Pat. Nos. 3,716,263; 3,733,098; 3,786,780; 3,819,220; 3,841,686; 3,912,316; 4,010,970 and 4,014,584.

Another prior art approach to the problem of dog feces entails the provision of a harness or framework including a plastic bag, which is mounted over the anal region of a small animal, such as a dog, so that when the animal has a bowel movement and defecates, the feces is caught in the bag which is disposable. Prior art relative to this approach to the solution of the problem of dog feces includes U.S. Pat. Nos. 3,656,459; 3,786,787; 3,792,687; 3,817,217 and 3,875,903.

With regard to containers and container lids, prior art configurations include those of U.S. Pat. Nos. 3,726,447; 3,894,650; 3,905,502; 3,910,444 and 3,913,774.

SUMMARY OF THE INVENTION

1. Purposes of the Invention

It is an object of the present invention to provide an improved container and container lid.

Another object is to provide an improved container lid with integral scoop.

A further object is to provide an improved article of manufacture for the removal and elimination of dog feces from the urban environment.

An additional object is to provide an inexpensive container lid with integral scoop for the transfer by manual manipulation of any solid substance such as a waste material from a surface on which it has been deposited into a container.

Still another object is to provide an improved means for removing deposited dog feces from a surface and cheaply containing the removed dog feces.

Still a further object is to provide a container and container lid with improved perimetral structure for the mounting of the lid to the container.

An object is to provide an improved container lid with integral scoop for usage with used standard steel cans.

An object is to provide a cheap and disposable means for refuse collection.

An object is to provide a container and container lid which can be used as a containing device for storage purposes or which can be disposed of, i.e. discarded, after a period of usage.

An object is to provide a container and container lid which can be suspended from its respective side or top by an integral hook which is part of the container or container lid.

An object is to utilize a previously discarded standard steel can after its primary and initial function of containing food or the like for transport to a consumer has ended.

An object is to provide a sealed sanitary container having an improved container lid, which container is suitable for disposal of refuse, e.g. dog feces, and will not easily open.

An object is to prevent flies and other parasites from infesting waste such as dog feces and possibly spreading disease.

An object is to provide a container and container lid for disposal of dog feces which can be suspended from the dog's own collar, if desired, until the actual cleanup is necessary.

These and other objects and advantages of the present invention will become evident from the description which follows.

2. Brief Description of the Invention

The present invention provides a cheap and disposable means for the collection of refuse such as dog feces, household kitchen scraps and peelings, shop waste, e.g. from a machine shop (nuts and bolts, turnings, shavings, engine grease), glue, sawdust, chips, trash, litter, etc. The invention consisting of a new configuration of container lid with integral scoop, and the container, can also be used as a containing device for storage purposes. After a period of usage, it can be disposed of, e.g. a last use containing an unsanitary material such as engine grease scooped off a surface, dog feces, etc. When used for storage, the lid or container can be suspended from the top or side by a hook means which is part of either the lid or container.

The lid alone (with integral scoop) can be used and sold, and because the scoop is molded to the lid's inside adjacent the inner protuberance, the lid can be made to fit over the upper edge of a standard steel can such as are used throughout the country for packing soups, vegetables, tuna fish, and even dog food. It is thus possible with the present invention, whether used as a whole or in part, i.e. the lid with integral scoop per se, to add more usage to a steel can that is normally thrown away after its primary purpose of holding a consumable material such as soup, vegetables, juice or even dog food is completed.

The lid with integral scoop could be manufactured in several sizes to make use of the various standard sized steel cans which are on the market and which are used to contain consumer products. The integral scoop of the lid, being adjacent the inner protuberance of the underside of the lid, is intended to fit also on the inside of whatever container the lid is fitted to; either the present new container configuration to be described infra, or the aforementioned standard steel can currently used for consumer products.

The present scoop in a preferred embodiment is intended to fit fairly closely to the side wall of the intended container, because in this manner the lid and integral molded scoop can easily be placed onto the open mouth and upper lid section of the container, because the scoop follows the side wall of the container down past what is being contained (dog feces, nuts and bolts, glue, sawdust, etc.), thereby insuring a more uniform fit to whatever container is being used.

The present lid and container can be made in small to even very large sizes, to accommodate varying disposal problems. The present invention, whether used as a complete unit (lid with integral scoop plus container), or the lid with integral molded scoop by itself, provides a sealed sanitary container suitable for disposal, which container will not open easily to inadvertently discharge the scooped-up contents. This is because the lid, when once emplaced, will not readily separate from the upper lip region of the present container or a standard steel can. Thus, one feature of the present lid with integral scoop, with or without the present container, is to prevent flies and other parasites from infesting contained waste and possibly spreading disease. When used for dog feces cleanup, the container and lid can be suspended from a molded hook on the side of the container or on the top of the lid, mounted on the pet's own collar (the owners of most dogs provide collars around the neck of their pets), until the actual cleanup is necessary.

Thus, the present lid with integral scoop is configured so that the scoop extends into the container at an angle when the lid is mounted to the container. Preferably, the scoop is perpendicular to the lid and thus parallel to the side wall of the container when the lid is emplaced on the open mouth of the container. Thus basically, the present invention brings together a disposable lid unit which is composed of a molded, e.g. plastic, self-sealing top and a disposable molded container (or standard steel can), with the top or lid designed to fit firmly onto and across the open mouth of the container.

The top or lid is molded as one piece, incorporating a hook on the center of the top, a self-sealing seal means about the perimeter of the disc-shaped lid which can be fitted to a standard steel can or to the present container configuration specifically made to fit the surfaces of the seal means. The lid or top is usually slightly hemispherical in shape and is disc-shaped, i.e. circular or round. Under the lid is a surface which is adjacent the outer perimeter of the lid. This is comparable to a skirt and is somewhat longer or wider than the actual outerside of the lid, and provides for ease of fitting a standard steel can or the present container, to close it with scooped-up contents inside, and to provide extra sealing and anti-collapsing if a very thin walled container is used, i.e. to support the upper mouth of the container.

As discussed supra, under the lid or top is also molded the scoop which is used for picking up dog feces or other wastes of a disposable nature, to be placed in a standard steel can, e.g. a soup can, or into the present new container.

The container is molded in one piece, as is the top or lid, with integral scoop. Generally, a pliable plastic material such as polyethylene, polypropylene or polyvinyl chloride will be employed as the material of construction. The entire container is generally cylindrical in configuration; however, the bottom of the container may be slightly smaller in diameter than the top (somewhat conical). The bottom of the container may be slightly hemispherical or flat. The present container also may have an outer hook on its side wall. This hook is similar in function and performance to the hook on the lid. Either hook can, while attached to the pet's collar, remain there through most of the pet's physical movements. The intended purpose is for the pet to carry the lid and/or the lid and container as a unit through the pet's normal exercise courses; then to be easily removed to recover any litter, i.e. dog feces, the animal has made; thereafter to be placed back on the collar whereupon the pet carries the lid and container as a unit to be properly disposed of in existing refuse containers or household garbage cans.

The present invention basically includes a container lid with integral scoop generally consisting of a disc-shaped member (the lid), means about the perimeter of the disc-shaped member for securing the disc-shaped member to the circular top free edge of an open cylindrical container, and a planar scoop means. The perimetral means includes at least inner and/or outer circular protuberances on opposite sides of an annular channel in the disc-shaped member. The scoop means depends from the annular inner portion of the disc-shaped member adjacent the inner circular protuberance. Preferably, the disc-shaped member is dome shaped.

In a preferred embodiment, the lid is provided with hook means which extend from generally the center of the disc-shaped member. The hook means preferably entails the provision of two hooks aligned on a common axis of symmetry and having opposed openings.

Typically the scoop means tapers inwards and away from the inner protuberance. Preferably an annular lip extends outwards from the perimeter of the disc-shaped member. In a preferred embodiment, a rectilinear spring clip is also provided in combination with the lid. The spring clip has upper and lower lateral extensions for engagement of, respectively, the edge of the disc-shaped member and the bottom edge of a container. Also, the spring clip will usually have a twisted portion along its length for manipulation of the spring clip.

In a preferred embodiment, the container lid is combined with a container of specific and optimum configuration. The present container is an open cylindrical container having a circular top free edge about its mouth, which free edge has a circular enlargement with an inner recess and an outer protuberance. Typically, the terminal surface of the free edge of the container is flat and inclined relative to the container wall, the terminal surface extending between the inner recess and the outer protuberance. The angle of inclination of the terminal surface is generally equal to the angle of enlargement of the scoop means adjacent the inner protuberance. Generally, a hook means will extend outwards from the surface of the wall of the container.

Preferably, the scoop means will have a curved surface, and in this case typically the scoop means will be concentric with the edge of the disc-shaped member.

The device of the present invention provides several salient advantages. The elimination of the dog feces from the urban environment has a salutary effect on the appearance and sanitary conditions in the public areas, as well as preventing soiling of shoes and even preventing disease among small children. The present device is inexpensive, rugged, serviceable, portable, and is manually operated and manipulated by young and old alike. Thus, the present device serves to aid in alleviating and arresting the highly prevalent urban decay which is due in some measure to the appearance of certain urban areas, i.e. litter, trash and other objects as well as dog feces may be removed from the urban areas, thus improving the cleanliness and appearance of even the worst slum areas.

Other significant advantages of the present invention have been discussed supra; however, it should also be mentioned that the present invention allows the user to remain clean and sanitary at all times; the present article of manufacture is cheap and easy to make and can be sold to the consumer at low cost; a previously wasted item (a used standard steel can) is salvaged and performs an additional useful function; the dog carries the unit like the Saint Bernard dog of Switzerland carries sustenance for stranded travelers in the ice and snows of the Alps; the present lid and container are easy to use and lawful; the can is easily removed and disposed of; and the present invention can be utilized and used generally around the dwellings or houses of people, in factories, machine shops, etc.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention:

FIG. 1 is a perspective view of a dog with container per se, and lid with integral scoop per se, each separately attached to the dog's collar;

FIG. 1A is an enlarged view of the container showing the suspension hook thereof attached to the dog's collar.

FIG. 2 shows the container lid with the integral molded scoop being used to remove a solid substance from a surface;

FIG. 3 shows a preferred embodiment of container, and container lid in place on the container, the lid being that of FIG. 2 after the substance has been scooped up;

FIG. 6 is a detail of a portion of an embodiment of the present lid with integral scoop as mounted to a standard steel can;

FIG. 7 shows another embodiment of the present lid as mounted to a standard steel can, together with associated rectilinear spring clip; and FIG. 8 is a partial sectional elevation view taken substantially along the line 8—8 of FIG. 7.

DETAILED DESCRIPTION OF THE PREFERRED EMBODIMENTS

Figure 4:
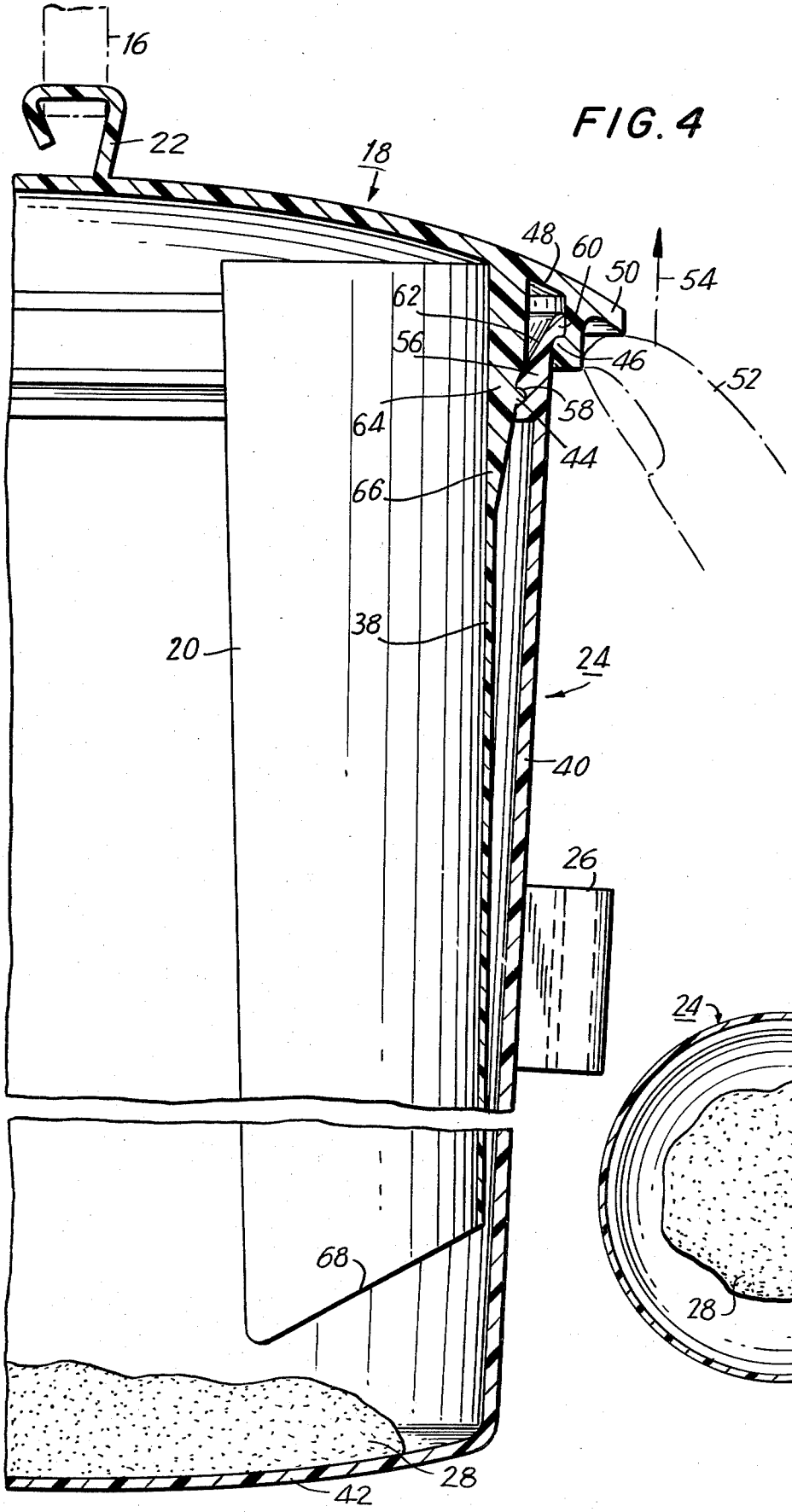
FIG. 4 is a sectional elevation view taken substantially along the line 4—4 of FIG. 3.

Referring now to FIG. 1, a dog 10 is held by a hand 12 of the owner via a leash 14 which extends to a collar 16 which circumscribes the neck of the dog 10. A plastic container lid 18 with integral molded scoop 20 is suspended from the collar 16 by means of a hook 22 which extends from the upper surface of the lid 18 about the collar 16. A plastic container 24 is also suspended from the collar 16, by means of a hook 26, which extends from the outer side surface of the container 24 about the collar 16 (see insert). As will appear infra, the open mouth of the container 24 is mateable with the lid 18, and these elements are mated with the scoop 20 inside the container 24, after the scoop 20 has been employed to manually scoop up feces discharged by the dog 10.

Figure 5:
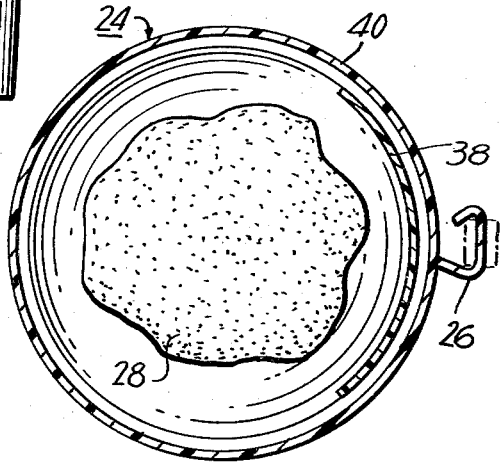
FIG. 5 is a sectional plan view taken substantially along the line 5—5 of FIG. 3.

FIG. 2 shows the manual manipulation of the lid 18 and integral scoop 20, to pick up or scoop up a body 28 of dog feces deposited by the dog 10 on a surface 30. The hand 12 grasps the hook 22, typically between the thumb 32 and forefinger 34, so that the entire lid-integral scoop unit may be manually manipulated and moved in the direction shown by an arrow 36, thereby scooping up the feces 28 onto the upper surface of the scoop 20, and off of the surface 30. Thereafter, elements 18 and 20 are held so that the scoop 20 is generally horizontal, until the lid 18 is fitted onto the open mouth of the container 24, shown in FIG. 3, with the scoop 20 inside the container 24, and with a section 38 of the scoop 20 disposed generally parallel to a wall 40 of the container 24, and with the dog feces 28 now collected in the bottom 42 of the container 24 (FIG. 4). As shown in FIG. 5, the section 38 and in fact most of the entire scoop 20 has a curved planar surface and the scoop 20 (section 38) is concentric with the wall 40 of the container 24. As best seen in FIG. 2, the scoop 20 being curved and planar is also concentric with the outer circular edge of the lid 18.

The outer edge of the disc-shaped lid member 18 is preferably provided with structure of a configuration to accommodate emplacement of the lid 18 onto the open mouth of either the present plastic container 24 or a standard-sized used steel can or container. This latter usage of lid 18 with integral scoop 20 will be discussed infra. The outer edge of the lid 18 is thus provided with (see FIGS. 2 and 4) means about the perimeter of the disc-shaped member 18 for securing the member 18 to the circular top free edge of an open cylindrical container per se. The perimetral securing means includes an inner circular protuberance 44 and an outer circular protuberance 46. As shown, the protuberances 44 and 46 are disposed on opposite sides of an annular channel 48 in the disc-shaped member 18, which in this embodiment of the invention is dome-shaped (see FIG. 4).

As shown, the planar scoop means 20 extends and depends from an annular inner portion of the disc-shaped member 18 adjacent the inner protuberance 44. In this embodiment of the invention, the scoop means 20 has a curved surface and is concentric with the circular edge of the disc-shaped member 18.

As shown in FIG. 4, the perimeter of the disc-shaped member 18 is preferably provided with an annular lip 50, the lip 50 extending outwards from the perimeter of the disc-shaped lid member 18. The lip 50 is provided so that, at the discretion of the user, the lid 18—integral scoop 20 combination is detachable from its mounting to the container 24 by manipulation, i.e. by placing the finger 52 under the lip 50 and exerting force in the upwards direction shown by arrow 54.

The open-mouthed container 24, in this embodiment of the invention, is provided with structure about its open mouth which cooperates with the annuar lid structure (elements 44, 46, 48) to detachably secure the lid member 18 to the container 24. Thus, the container 24 is an open cylindrical container having a circular top free edge 56 about its mouth (FIG. 4). The free edge 56 is or has a generally circular enlargement with an inner circular channel 58 and an outer circular protuberance 60. As shown, the channel 58 receives and cooperates with the inner lid protuberance 44 described supra, with the protuberance extending into the channel 58. Concomitantly, the protuberance 60 extends into the channel 48 and is juxtaposed with the outer lid protuberance 46 described supra in a contiguous relationship, so that as seen in FIG. 4, the lid member 18 is firmly held to the free edge enlargement 56 of the container 24. This attachment is detachable, e.g. by moving the finger 52 upwards per arrow 54 as described supra, since the lid member 18 and the container 24 are composed of a flexible resilient plastic, e.g. polyvinyl chloride, polyethylene, or polypropylene, so that the lid 18 may be snapped on or off of the container 24.

In this preferred embodiment of the invention, terminal surface 62 of the free edge 56 of the container 24 is inclined, typically at an acute angle, relative to the container wall 40, with the terminal surface 62 extending between the inner channel 58 and the outer protuberance 60. As shown in FIG. 4, the angle of inclination of the terminal surface 62 is generally equal to the angle of enlargement of the scoop means 20 at 64 adjacent its inner protuberance 44.

In this preferred embodiment of the invention, the scoop means 20 is also characterized by the provision of additional structural features. Thus, the scoop means 20 tapers at 66 inwards and away from its inner protuberance 44. Also, as seen in FIGS. 2 and 4, the free working edge or tip 68 of the scoop means 20 curves inwards from its lateral ends so as to provide a central recess region which facilitates initial passage of the feces 28 centrally onto the upper surface of the scoop 20 (FIG. 2). Thus the feces 28 is not dispersed laterally when being removed from the surface 30, but instead is centrally directed along the longitudinal axis of the scoop means 20 and towards the lid member 18.

Referring now to FIG. 6, the lid member 18 with integral scoop 20 as described supra is shown in place in conjunction with a used standard sized steel can or container 70. The lid 18-scoop 20 combination has been emplaced over the open mouth of the can 70, which open mouth has the typical can edge 72 as commercially manufactured with a circular bead or folded over ridge edge enlargement which was made when the can 70 was previously top sealed with its original contents inside, e.g. soup, vegetables, juice, dog food, etc. As shown, the present lid configuration accommodates the securing of the lid 18 to the used standard sized steel can 70, with the outer protuberance 46 of the lid 18 fitting in under the outer portion of the bead or can edge 72.

In a preferred embodiment of the invention as shown in FIGS. 7 and 8, alternative and ancillary structure may be provided in instances when the lid-scoop combination is to be primarily made, sold and used specifically in conjunction with a used standard sized steel can. Thus, referring now to FIGS. 7 and 8, the invention in this instance includes a rectilinear spring clip 74 which is mounted to the balance of the members after a lid 76 has been emplaced over the open mouth of a used standard sized steel can 78. The spring clip 74 has an upper lateral extension 80 for engagement of the edge of the disc-shaped lid member 76. As last seen in FIG. 8, the lid member 76 in this embodiment of the invention has an annular channel 82 to accommodate the bent or curved end 84 of the upper lateral extension 80. The spring clip 74 also has a lower lateral extension 86 for engagement of the bottom edge 88 of the container 78. The provision of the rectilinear spring clip serves to supplement the primary mode of engagement of the lid 76 to the container 78, e.g. as shown in FIG. 8, the bead 90 about the edge of the mouth of the can 78 fits into a lateral channel 92 in the annular edge 94 of the lid 76, with the outer protuberance 96 of the lid 76 fitting in under the outer portion of the bead or can edge 90. The rectilinear spring clip 74 may be sold as a component of a unitary package including the present lid with integral scoop, a number of lids with a reusable clip.

Finally, referring to FIG. 7, in this preferred embodiment of the invention, the spring clip 74 has a twisted portion 98 along its length, for manipulation of the spring clip 74. Also, an alternative embodiment of hook means is shown in FIG. 7, i.e. two hooks 100 and 102 on the lid 76, the hooks 100 and 102 being aligned on a common axis of symmetry and having opposed openings.

It will be appreciated by those skilled in the art that the specific hook means selected in a particular instance, or for that matter other appurtenances to the invention as described supra, will be selected by one skilled in the art in a particular instance depending on the particular application of the invention. Thus, for example, in large scale applications, e.g. the moving or spreading of sand or rock salt, it would be advantageous to have the lid and scoop made thicker in dimension and/or material. In this case, the lid-scoop combination would not really be disposable, and a suitable handle could be provided on the top of the lid instead of a hook. This would be especially true if the lid was intended to fit onto the mouth of the larger used standard steel cans, e.g. juice cans originally used to contain orange, tomato, apple or grapefruit juice or vegetable juice cocktail.

It thus will be seen that there is provided a container and container lid which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A container lid with integral scoop which comprises a disc-shaped member, means about the perimeter of said disc-shaped member for securing said disc-shaped member to the circular top free edge of an open cylindrical container, said disc-shaped member having an annular channel adjacent its perimeter, said perimetral securing means including at least an inwardly facing outer circular protuberance adjacent the outer side of said annular channel in said disc-shaped member, and a curved scoop means, said curved scoop means depending from an annular inner portion of said disc-shaped member adjacent said annular channel.

2. The container lid of claim 1 in which the disc-shaped member is dome shaped.

3. The container lid of claim 1 together with a hook means, said hook means extending from substantially the center of the disc-shaped member.

4. The container lid of claim 3 in which the hook means comprises two hooks aligned on a common axis of symmetry and having opposed openings.

5. The container lid of claim 1 in which an annular lip extends outwards from the perimeter of the disc-shaped member.

6. The container lid of claim 1 together with a rectilinear spring clip, said spring clip having upper and lower lateral extensions for engagement of, respectively, the edge of the disc-shaped member and the bottom edge of a container, said spring clip having a twisted portion along its length for manipulation of said spring clip.

7. The container lid of claim 1 together with a container, said container being an open cylindrical container and having a circular top free edge about its mouth, said free edge having a substantially circular enlargement with an inner circular channel and an outer circular protuberance, the perimetral securing means of the container lid including an outwardly facing inner circular protuberance adjacent the inner side of the annular channel in the disc-shaped member, said inner circular protuberance being mateable with said inner circular channel in said enlargement of the free edge of said container.

8. The container lid of claim 7 in which the terminal surface of the free edge of the container is inclined relative to the container wall, said terminal surface extending between the inner channel and the outer protuberance, the scoop means tapering inwards and away from the annular channel in the disc-shaped member, to provide an angular enlargement adjacent the channel, the angle of inclination of the terminal surface of the free edge of the container being substantially equal to the angle of enlargement of the scoop means adjacent the annular channel in the disc-shaped member.

9. The container lid of claim 7 together with a hook means, said hook means extending outwards from the surface of the wall of the container.

10. The container lid of claim 1 in which the scoop means is concentric with the edge of the disc-shaped member.

11. The container lid of claim 1 in which the disc-shaped member and the scoop means are composed of a plastic selected from the group consisting of polyvinyl chloride, polyethylene and polypropylene.

12. The container lid of claim 1 in which the scoop means has a free working edge which curves inwards from its lateral ends so as to provide a central recess region at said free working edge.

* * * * *